US009660347B2

(12) United States Patent
Du et al.

(10) Patent No.: US 9,660,347 B2
(45) Date of Patent: May 23, 2017

(54) PRINTED COUPLED-FED MULTI-BAND ANTENNA AND ELECTRONIC SYSTEM

(71) Applicant: ARCADYAN TECHNOLOGY CORPORATION, Hsinchu (TW)

(72) Inventors: Jian-Jhih Du, Taipei (TW); Jing-Teng Chang, Hsinchu County (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 0 days.

(21) Appl. No.: 14/846,852

(22) Filed: Sep. 7, 2015

(65) Prior Publication Data

US 2016/0301140 A1 Oct. 13, 2016

(30) Foreign Application Priority Data

Apr. 8, 2015 (TW) ..... 104111239 A

(51) Int. Cl.
*H01Q 9/04* (2006.01)
*H01Q 9/06* (2006.01)
(Continued)

(52) U.S. Cl.
CPC ..... *H01Q 9/0457* (2013.01); *H01Q 1/243* (2013.01); *H01Q 1/38* (2013.01); *H01Q 5/364* (2015.01);
(Continued)

(58) Field of Classification Search
CPC .... H01Q 9/0442; H01Q 9/0457; H01Q 9/065; H01Q 9/42; H01Q 1/38
See application file for complete search history.

(56) References Cited

U.S. PATENT DOCUMENTS 7,183,979 B1 * 2/2007 Liu ..... H01Q 9/0442 343/700 MS
8,378,897 B2 * 2/2013 Lai ..... H01Q 9/42 343/700 MS
(Continued)

FOREIGN PATENT DOCUMENTS

TW 201034285 A 9/2010
TW 201034285 A1 9/2010
(Continued)

*Primary Examiner* — Hoang Nguyen
(74) *Attorney, Agent, or Firm* — Li & Cai Intellectual Property (USA) Office

(57) ABSTRACT

The disclosure is related to a printed coupled-fed multi-band antenna, and a related electronic system. The antenna includes a first antenna member structurally with a mushroom-shaped radiation portion and an antenna connection portion being electrically connected with a ground plane. The mushroom-shaped radiation portion is employed to activate first band electromagnetic wave. The antenna includes a second antenna member, which may be shaped as a U-shaped radiation portion. The second antenna member is floating within a region surrounded by the mushroom-shaped radiation portion, the antenna connection portion and the ground plane. The U-shaped radiation portion is coupled with both the ground plane and the mushroom-shaped radiation portion. The coupling effect allows the second antenna member to activate a second band electromagnetic wave. The multiple band signaling paths are formed over the printed antenna for application of a multi-band antenna.

15 Claims, 8 Drawing Sheets

(51) Int. Cl.

| | |
|---|---|
| ***H01Q 1/24*** | (2006.01) |
| ***H01Q 1/38*** | (2006.01) |
| ***H01Q 9/42*** | (2006.01) |
| ***H01Q 5/364*** | (2015.01) |
| ***H01Q 5/392*** | (2015.01) |

(52) U.S. Cl.
CPC ..... *H01Q 5/392* (2015.01); *H01Q 9/0442* (2013.01); *H01Q 9/065* (2013.01); *H01Q 9/42* (2013.01)

(56) References Cited

U.S. PATENT DOCUMENTS

| | | | | |
|---|---|---|---|---|
| 8,754,817 | B1 | 6/2014 | Kuo et al. | |
| 2012/0081264 | A1 | 4/2012 | Wang et al. | |
| 2014/0104134 | A1 | 4/2014 | Chen et al. | |
| 2014/0253398 | A1 | 9/2014 | Hsieh et al. | |
| 2015/0180117 | A1* | 6/2015 | Ruan ..... | H01Q 9/0421 343/841 |

FOREIGN PATENT DOCUMENTS

| | | |
|---|---|---|
| TW | I379457 | 12/2012 |
| TW | I423521 B | 1/2014 |

* cited by examiner

PRINTED COUPLED-FED MULTI-BAND ANTENNA AND ELECTRONIC SYSTEM

BACKGROUND OF THE INVENTION

1. Field of the Invention

The present invention is related to a multi-band antenna and an electronic system, in particular to a printed monopole multi-band antenna with signal feeding using coupling effect, and a related electronic system.

2. Description of Related Art

The capability of computation and signal processing electronic devices is getting more powerful with advances in modern technology, especially the innovation in wideband network and multimedia services to meet the requirements of higher transmission rates.

The gradually progressive mobile communication network such as the LTE (Long Term Evolution) particularly defines the specification supporting multiple-frequency bandwidth in accordance with the fourth generation mobile communication protocol. That means the 4G/LTE mobile communication protocol is specified to cover bandwidths such as low frequency around 698 MHz to 798 MHz, high frequency around 2300 MHz to 2690 MHz, and further include more band ranges in the future. The advancement may result in higher mobile communication bandwidth and more various multimedia services. Compared to the current prevailing mobile systems such as 2G/GSM and 3G/UMTS, the 4G/LTE network system integrates the bandwidths in the 2G/3G/4G mobile systems. In addition to including the current technologies, the larger bandwidth and higher transmission offered by the 4G/LTE network system is attractive to the subscribers.

It is noted that the LTE network system applies much more wave bands, however the different countries may adopt the different band ranges and make their LTE systems not compatible with each other. For example, the LTE system in North America uses the range over 700/800 MHz and 1700/1900 MHz; the LTE system in Europe over 800 MHz, 1800 MHz, and 2600 MHz; the LTE system in most of the Asian countries uses the bands over 1800 MHz and 2600 MHz; and the system in Australia is in 1800 MHz. Therefore, an antenna in a terminal device may be required to support multiple frequency bands so as to possibly roam in many countries.

SUMMARY OF THE INVENTION

To allow a single electronic system to support the communications in compliance with multiple frequency bands, a printed coupled-fed multi-band antenna in accordance with the invention is provided. The printed coupled-fed multi-band antenna is configured to have a plurality of signaling paths over the printed antenna for conveying multi-frequency signals.

In one of the embodiments, the main components of the printed coupled-fed multi-band antenna are exemplarily a first antenna member having a T-shaped or an L-shaped mushroom-shaped radiation portion and an antenna connection portion providing the first antenna member to connect with a ground plane. The mushroom-shaped radiation portion is essentially used to activate a first band electromagnetic wave. The antenna also has a second antenna member which may be a U-shaped radiation portion floating within a region surrounded by the mushroom-shaped radiation portion, the antenna connection portion and the ground plane. In the structure, the U-shaped radiation portion is essentially connecting a first radiation arm, a second radiation arm, and an electric connection portion. The electric connection portion includes two ends opposite to each other, and the two ends are used to connect with the first radiation arm and the second radiation arm respectively.

When the first radiation arm of the U-shaped radiation portion is next to the ground plane, a coupling effect is enhanced. When the second radiation arm of the U-shaped radiation portion is next to the mushroom-shaped radiation portion, another coupling effect is also induced. The coupling effect between the first radiation arm and the second radiation arm may enable the second antenna member to activate the second band electromagnetic wave inducing an optimized frequency response.

In one further aspect, the printed coupled-fed multi-band antenna includes a third antenna member which is extended from the printed conductor of the antenna connection portion of the first antenna member. The extended length of the third antenna member is tuned to activate a third band electromagnetic wave.

When the system needs to activate a fourth band electromagnetic wave, an L-shaped first radiation portion, which is formed in the mushroom-shaped radiation portion, is provided with adjusted length for activating the fourth band electromagnetic wave.

One or more extended conductors may be formed in the printed coupled-fed multi-band antenna by a manufacturing method, used to tune the impedance matching of the whole antenna. Furthermore, a plurality of slots may also be formed for defining more radiation portions over other bands.

In another aspect, the disclosure is related to an electronic system having the printed coupled-fed multi-band antenna.

DETAILED DESCRIPTION OF THE PREFERRED EMBODIMENTS

The present invention now will be described more fully hereinafter with reference to the accompanying drawings, in which preferred embodiments of the invention are shown.

This invention may, however, be embodied in many different forms and should not be construed as limited to the embodiments set forth herein; rather, these embodiments are provided so that this disclosure will be thorough and complete, and will fully convey the scope of the invention to those skilled in the art.

The disclosure is related to an antenna, and more particularly to a monopole coupled-fed multi-band antenna. For implementing multi-frequency waves carried by one single printed antenna, the antenna in structure is configured to have multiple signaling paths for the multiple frequencies.

The printed coupled-fed multi-band antenna in the disclosure has two essential portions forming a monopole multi-frequency bands antenna.

Figure 1:
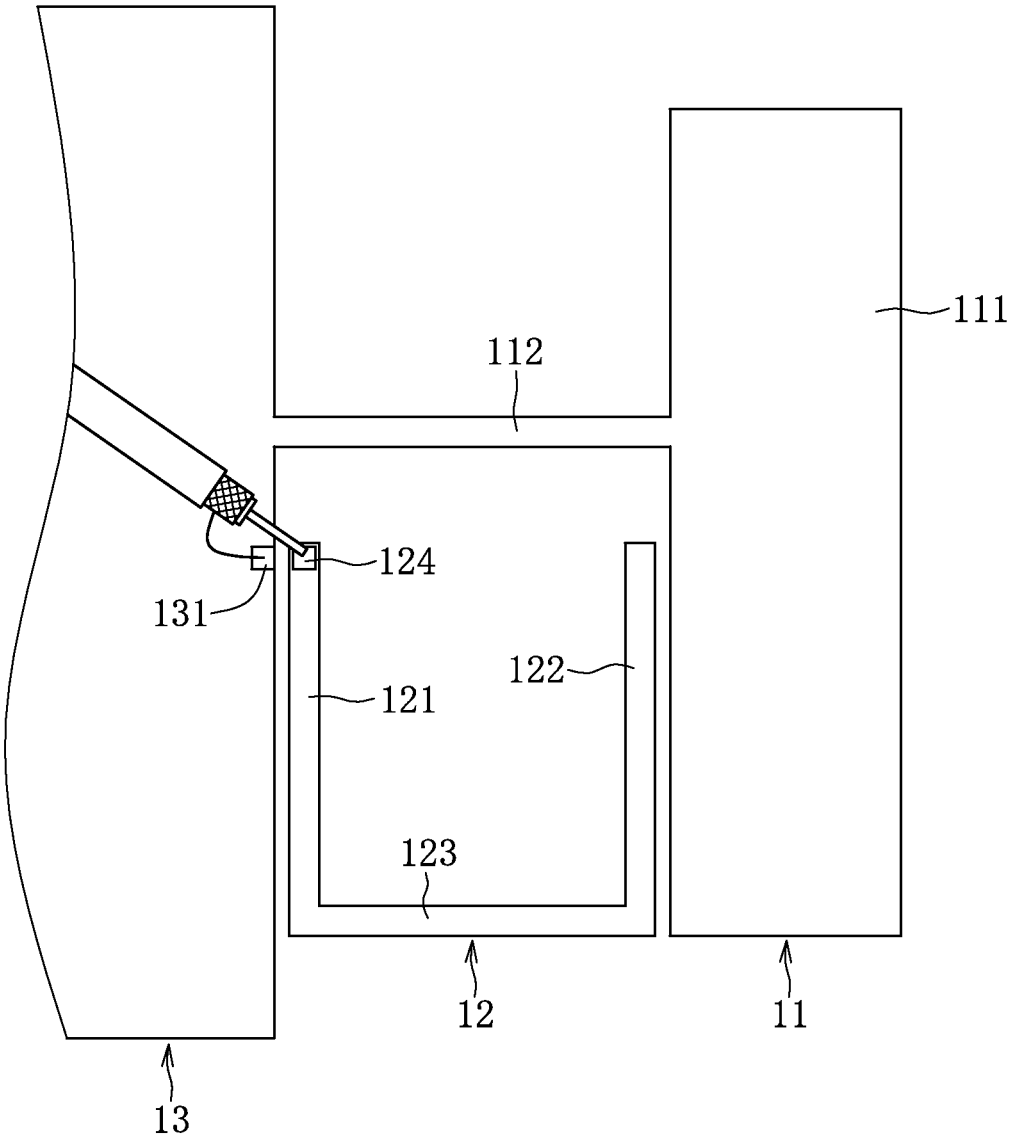
FIG. 1 shows a schematic diagram depicting a printed coupled-fed multi-band antenna according to one aspect of the present invention.

In FIG. 1, a printed coupled-fed monopole multi-frequency antenna is shown. The antenna easily meets the requirement of a specific operating frequency for the system. A first antenna member 11 is a printed conductor, and its main component is a mushroom-shaped radiation portion 111. The mushroom-shaped radiation portion 111 is electrically connected to a ground plane 13 of the system via an antenna connection portion 112. The ground plane is such as an extending structure of a back-end electronic system. The structure is specifically designed for an electronic system, but not limited to any specific application.

Figure 5:
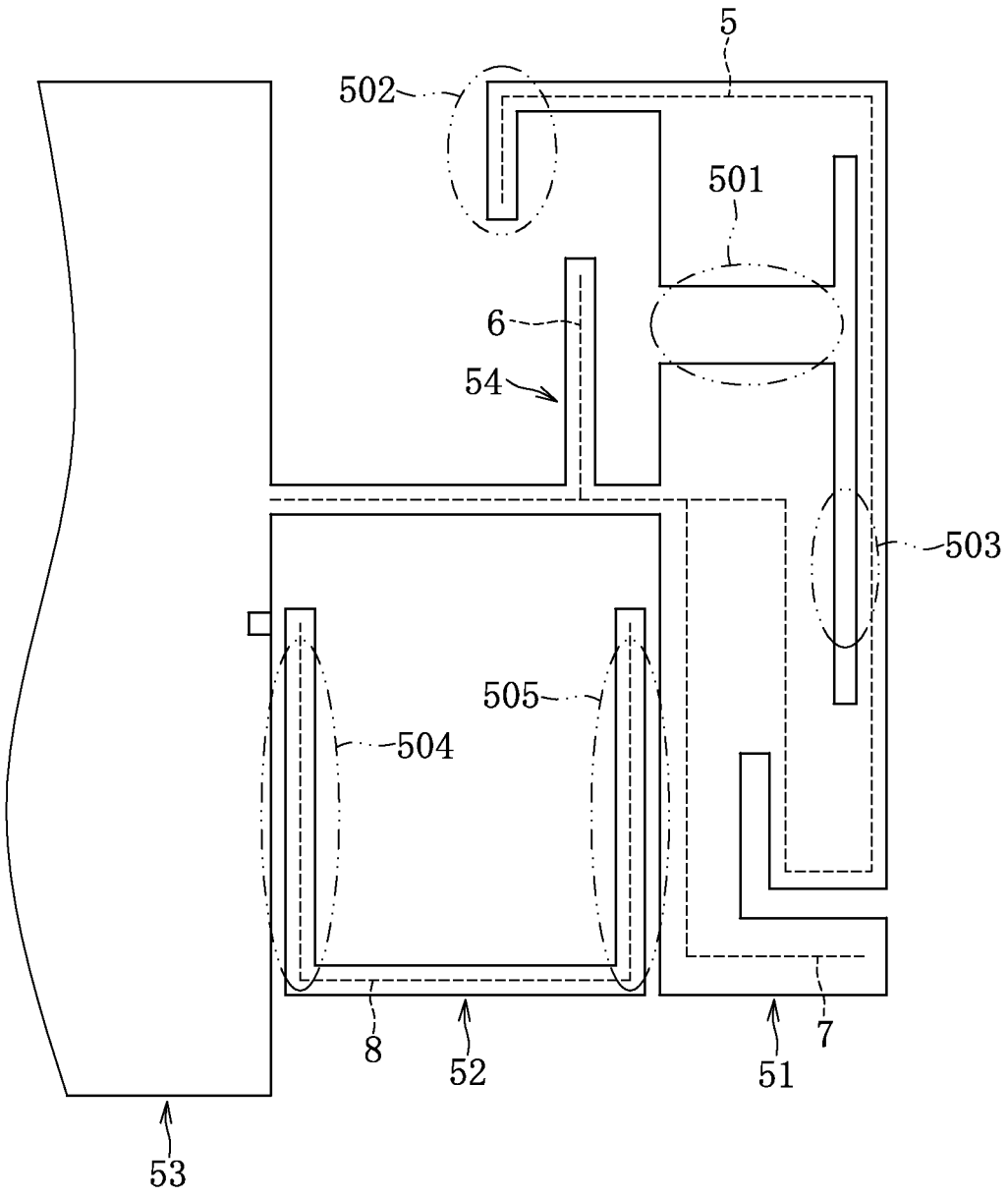
FIG. 5 show a schematic diagram of the printed coupled-fed multi-band antenna according to one further embodiment of the present invention.

The configuration of the mushroom-shaped radiation portion 111 is to activate a first band electromagnetic wave. The mushroom-shaped radiation portion 111 is structurally adjustable forming various formations through manufacturing process. The mushroom-shaped radiation portion 111 can be configured to have multiple signaling paths for various operating frequencies, so as to activate the multiple electromagnetic waves. According to one of the embodiments, a first band electromagnetic wave is activated by the mushroom-shaped radiation portion. FIG. 5 schematically shows a first band signaling path 5, around 700~900 MHz, or/and a fourth band signaling path 7, around 1.7 GHz. The mushroom-shaped radiation portion activates a specific range of electromagnetic wave configured to be a first band electromagnetic wave.

The other main radiation component of the printed coupled-fed monopole multi-frequency antenna is a second antenna member 12. As shown in the FIG. 1, the second antenna member 12 is a near U-shaped radiation conductor. The U-shaped radiation portion essentially includes a first radiation arm 121, a second radiation arm 122, and an electric connection portion 123. A coupling effect may be generated since the first radiation arm 121 is next to the ground plane 13. The coupling effect may also be induced between the second radiation arm 122 and the mushroom-shaped radiation portion 111. The two ends of the conductive electric connection portion 123 are respectively connected with the first radiation arm 121 and the second radiation arm 122.

The near U-shaped second antenna member 12 does not contact any adjacent conductor, that means the second antenna member 12 is floating within a region surrounded by the mushroom-shaped radiation portion 111 of the first antenna member 11, the antenna connection portion 112, and the ground plane 13. The length of the second antenna member 12 is configured to meet the requirement of activating a specific electromagnetic wave. A second band signaling path 8 schematically shown in FIG. 5 is used to serve a waveband of 2.17 GHz, being a second band electromagnetic wave.

The printed coupled-fed multi-band antenna has a ground feeding point 131 disposed in the first antenna member 11 for bridging to the ground plane 13, and a signal feeding point 124 disposed at one end of the first radiation arm 121 of the second antenna member 12. The ground feeding point 131 is adjacent to the signal feeding point 124. The ground feeding point 131 has a distance from the signal feeding point 124 and may result in an electrical coupling used to be the contact for feeding signals.

The conventional PIFA (Planar Inverted F Antenna) antenna may encounter the problem of narrower bandwidth. On the contrary, the printed coupled-fed multi-band antenna utilizes the coupling effect among the adjacent conductors of the antenna structure to overcome the limitation of the bandwidth. It is noted that the coupling effect allows the two separate conductors to establish interconnection and make the energies interact with each other. Within the general circuitry, the coupling effect may damage the performance of the system. However, the coupling effect applied to the printed coupled-fed multi-band antennas of the present invention may overcome the limitation of bandwidth, and increase the bandwidth.

The electric relationship between the antenna and the system may couple the ground feeding point 131 and the signal feeding point 124. One of the schemes to feed the signals is utilizing a cable to weld the ground feeding point 131 and the signal feeding point 124, and extend to the radio-frequency circuit of the system. The cable may also be reduced to save cost when the antenna signals are fed to the printed circuit of the system.

Figure 2:
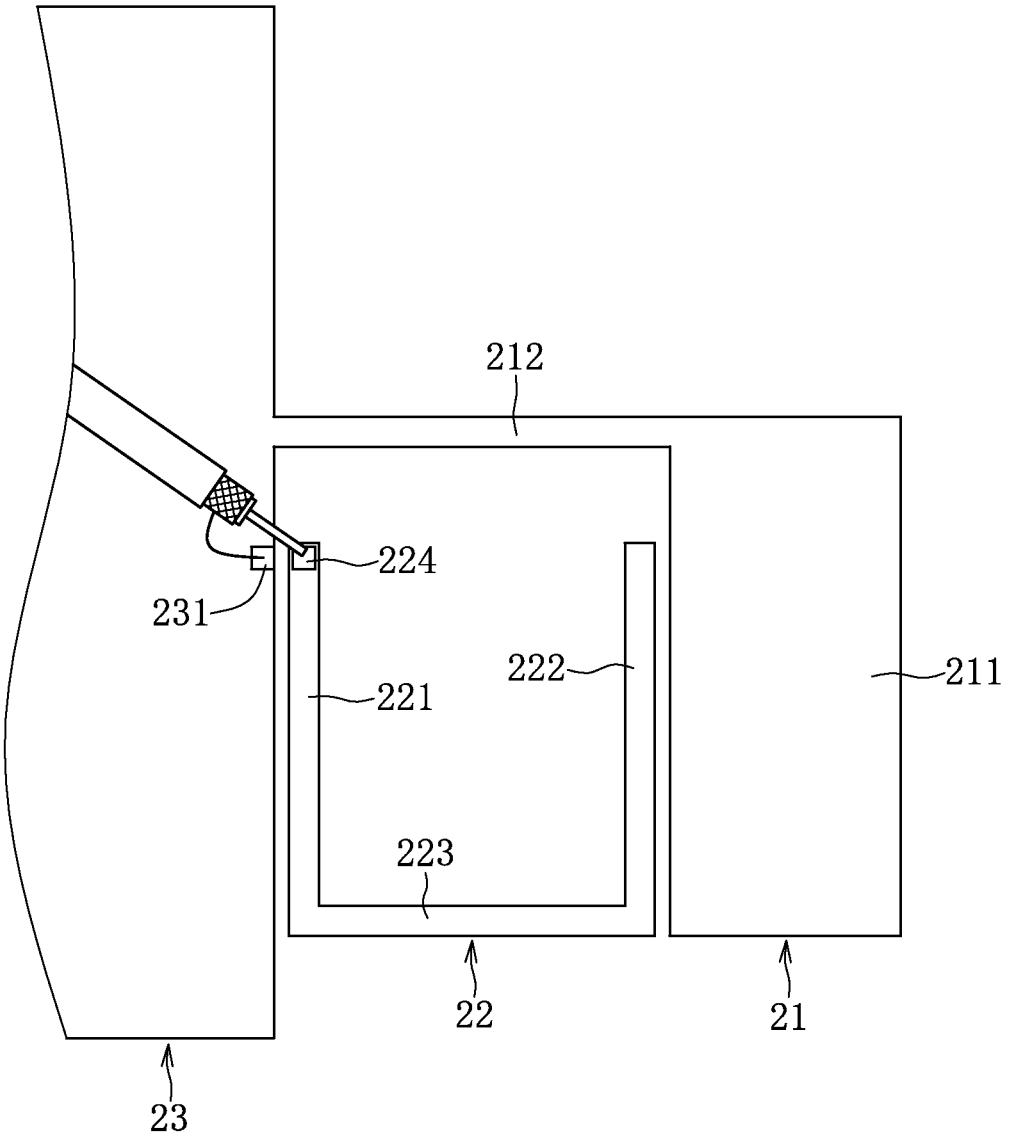
FIG. 2 shows a schematic diagram depicting the printed coupled-fed multi-band antenna in another aspect of the present invention.

Compared to the mushroom-shaped radiation portion shown in FIG. 1 depicting a T-shaped radiation portion, the mushroom-shaped radiation portion may also be the embodiment shown in FIG. 2 depicting an L-shaped radiation portion.

The main components of the antenna shown in FIG. 2 have a first antenna member 21 and a second antenna member 22. The first antenna member 21 has an L-shaped mushroom-shaped radiation portion 211, and an antenna connection portion 212 electrically connected with a ground plane 23. The mushroom-shaped radiation portion 211 is electrically connected with the ground plane 23 via the antenna connection portion 212. The mushroom-shaped radiation portion 211 is used to activate the electromagnetic wave over a specific waveband. The second antenna member 22 is such as a near U-shaped conductor in the antenna. The second antenna member 22 is essentially consisting of a first radiation arm 221, a second radiation arm 222, and an electric connection portion 223. The second antenna member 22 is particularly floating within a region surrounded by the mushroom-shaped radiation portion 211, the antenna connection portion 212, and the ground plane 23.

In the layout, the first radiation arm 221 of the U-shaped radiation portion and the ground plane 23 are adjacent structures. The coupling effect may be induced when the first radiation arm 221 and the ground plane 23 are apart from each other for a suitable distance. The second radiation arm 222 of the U-shaped radiation portion is also adjacent to the mushroom-shaped radiation portion 211. The coupling effect may also be induced in a distance there-between. The coupling effect induced between the first radiation arm 221 and the second radiation arm 222 may force the second antenna member 22 to activate a specific waveband electromagnetic wave inducing an optimized frequency response. When the antenna is applied to an electronic system, the ground plane 23 has a ground feeding point 231, and the second antenna member 22 has a signal feeding point 224.

Figure 3:
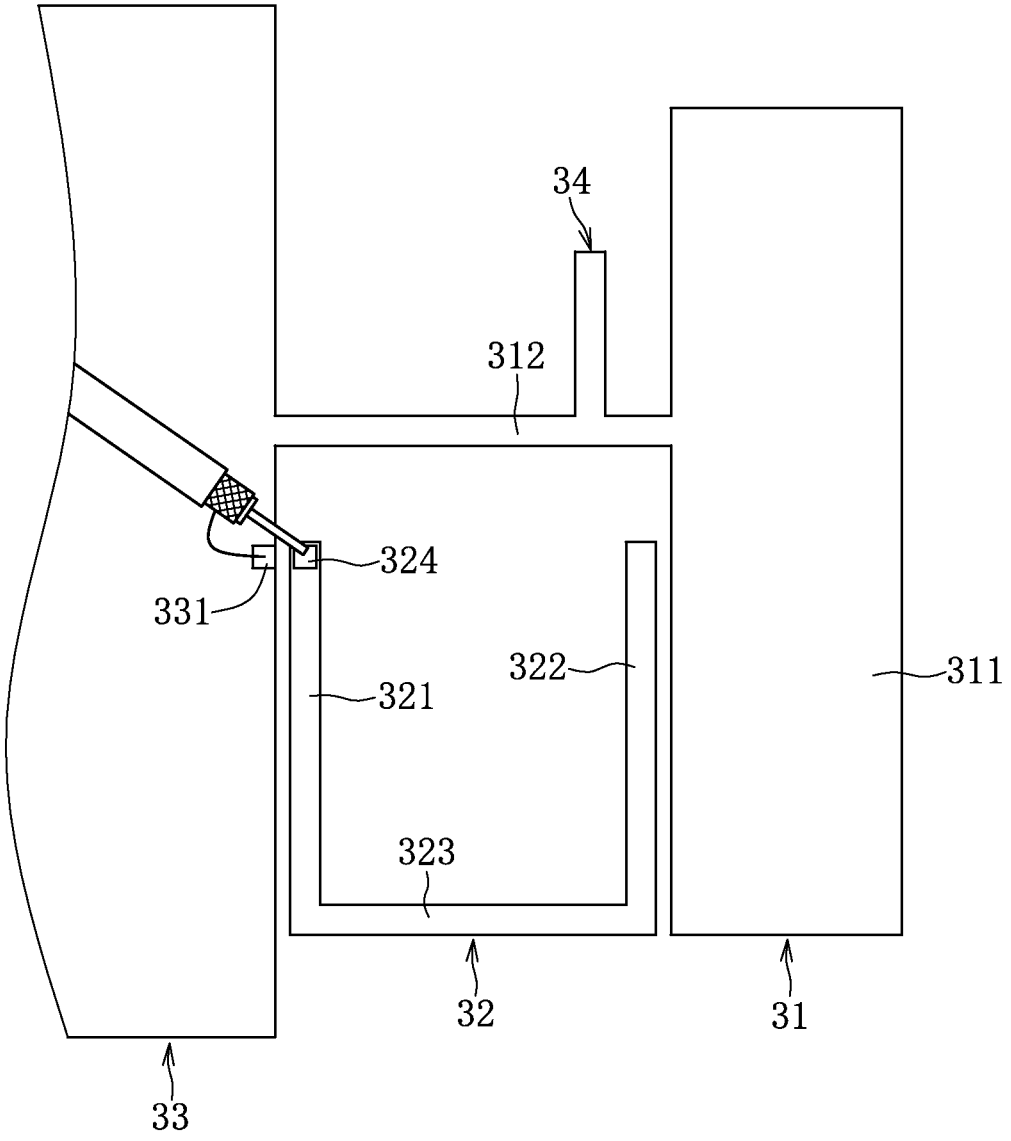
FIG. 3 shows a schematic diagram of the printed coupled-fed multi-band antenna according to one further aspect of the present invention.

Reference is made to FIG. 3 depicting the printed coupled-fed multi-band antenna according to one further embodiment. The printed structure may be changed for the purpose of inducing the radiation signals in some other wavebands.

In the current embodiment, the antenna essentially includes a first antenna member 31, a second antenna member 32, and a third antenna member 34. The system also includes a ground plane 33. As the antenna shown in the diagram, the first antenna member 31 has a T-shaped mushroom-shaped radiation portion 311, and an antenna connection portion 312 electrically connected with the ground plane 33. The mushroom-shaped radiation portion 311 may also be L-shaped structure. The second antenna member 32 is likely a U-shaped member including a first radiation arm 321, and a second radiation arm 322, and an electric connection portion 323.

Similarly, the second antenna member 32 induces a coupling effect with its adjacent conductor, e.g. the coupling effect induced between the first radiation arm 321 and the ground plane 33. The second radiation arm 322 is also electrically coupled with the mushroom-shaped radiation portion 311 of the first antenna member 31. The coupling effect for the antenna is utilized to enhance the overall performance of bandwidth.

Furthermore, the printed coupled-fed multi-band antenna may be configurable to support the other wavebands of the electromagnetic radiation. For example, the third antenna member 34 is the member extended from the antenna connection portion 312 of the first antenna member 31. The third antenna member 34 is grounded via the antenna connection portion 312. Both the third antenna member 34 and the first antenna member 31 are similarly coupled with the ground plane 33 via the antenna connection portion 312. The length of the third antenna member 34 can be configured to radiate another waveband of electromagnetic wave, namely the third band electromagnetic wave. According to the example shown in FIG. 5, the third antenna member 34 forms a shorter third band signaling path 6 that may exemplarily serve the waveband of 2.7 GHz.

Reference is made to FIG. 3 describing a signal feeding point 324 formed with an end of the second antenna member 32 and a ground feeding point 331 of the ground plane 33 in the second antenna member 32 of the multi-band antenna. Both the signal feeding point 324 and the ground feeding point 331 are electric contacts connecting with a back-end electronic system.

Figure 4:
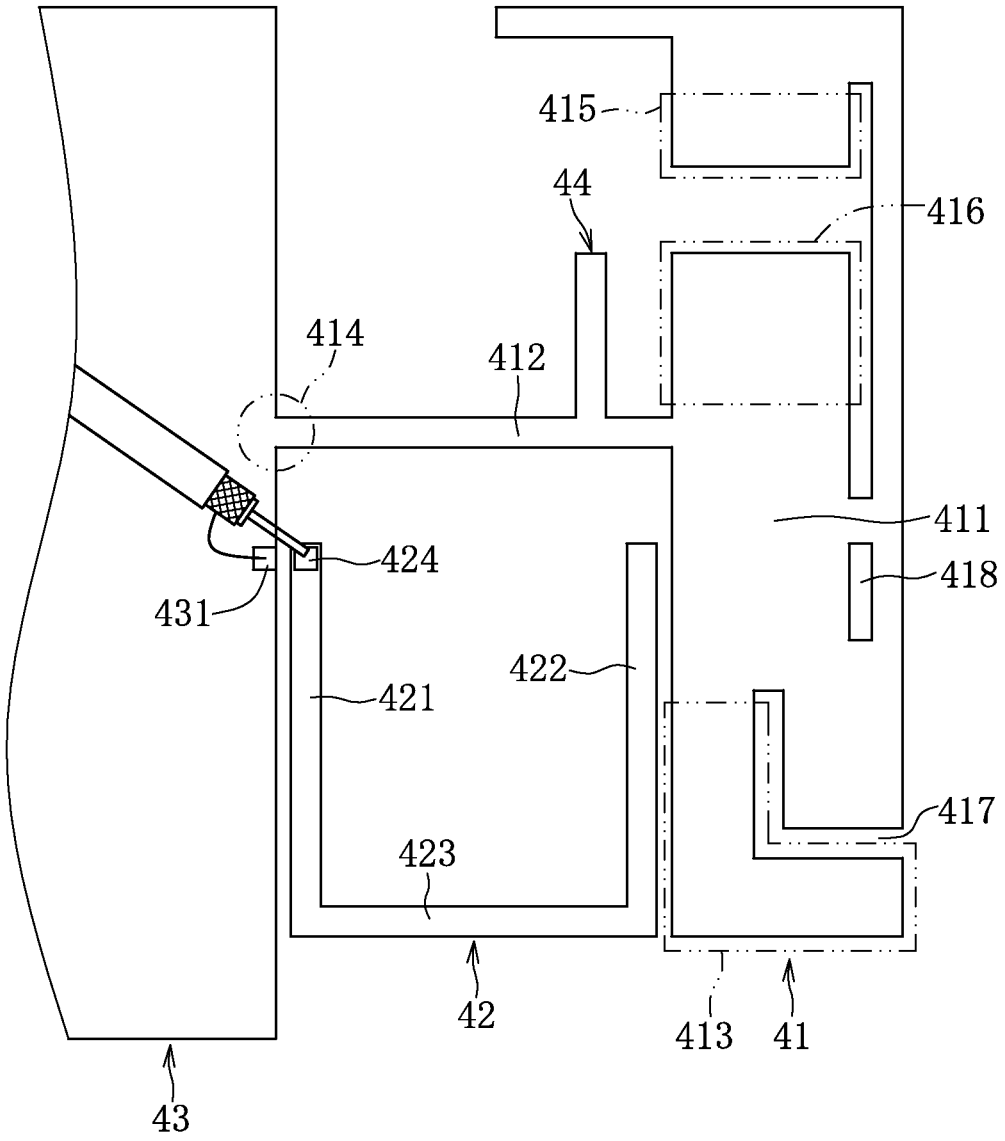
FIG. 4 shows a schematic diagram of the printed coupled-fed multi-band antenna in one further embodiment of the present invention.

FIG. 4 and FIG. 5 show the schematic diagrams respectively depicting the structural functions of the printed coupled-fed multi-band antenna.

In FIG. 4, the radiation members are such as a first antenna member 41, a second antenna member 42, and a third antenna member 44. The first antenna member 41 has a mushroom-shaped radiation portion 411 and an antenna connection portion 412 extended for electrically connecting with a ground plane 43. The connecting portion between the antenna connection portion 412 and the ground plane 43 is such as a ground connection portion 414. The mushroom-shaped radiation portion 411 is formed as the radiation portion extended from the antenna connection portion 412. The other end of the ground connection portion 414 is electrically connected with the ground plane 43.

The second antenna member 42 may be exemplarily in the form of a U-shaped conductor. The second antenna member 42 includes a first radiation arm 421, a second radiation arm 422, and an electric connection portion 423. One end of the second antenna member 42 forms a signal feeding point 424 for feeding the electric signals from an electronic system. The length of the radiation area of the second antenna member 42 may be elongated in compliance with operation over a second band electromagnetic wave of the antenna, e.g. a middle frequency of the electromagnetic wave. The third antenna member 44 is exemplarily extended from the antenna connection portion 412, and is at an opposite side from the second antenna member 42. That means, relative to the antenna connection portion 412, the extending direction of the third antenna member 44 is far away from the second antenna member 42. Similarly, the length of the third antenna member 44 may be adjusted in compliance with operation over a third band electromagnetic wave, e.g. a high frequency electromagnetic wave.

The mushroom-shaped radiation portion 411 of the first antenna member 41 is the main body of the antenna. A first band electromagnetic wave may be adjusted through modifying the extended length of the mushroom-shaped radiation portion 411. The longer signaling path serves the lower band of electromagnetic wave. The mushroom-shaped radiation portion 411 may form various types of the structure through manufacturing processes. The various features of the structure form various signaling paths.

One of the structural features of the mushroom-shaped radiation portion 411 is, but not limited to, an L-shaped slot 417 formed by a specific manufacturing feature. The L-shaped structure is a semi-closed slot having an opening at one end. The opening is at one side of the mushroom-shaped radiation portion 411. An L-shaped matching section 413, as the radiation section shown in the bottom of the figure, is defined by this slot 417 in the mushroom-shaped radiation portion 411 and the other closed end of the slot 417 adjacent to the second antenna member 42. The dimension including length and width of the slot 417 is adjustable for serving an operating frequency, and its matching. The L-shaped matching section 413 forms the shape 'L' by a manufacturing process. To refer to the multiple signaling paths shown in FIG. 5, the L-shaped matching section 413 from the antenna connection portion 412 forms a fourth band signaling path 7 by a matching length. The fourth band signaling path 7 serves an around 1.7 GHz electromagnetic wave.

Further, a slot 418 is formed inside the body of the mushroom-shaped radiation portion 411. The slot 418 is a closed slot, but not limited to the shape shown in the diagram. The slot 418 is configured to modify the radiation path inside the mushroom-shaped radiation portion 411 so as to adjust the wave band of the antenna. For example, the configuration of the slot 418 is able to increase a low operating frequency.

The above embodiments describe one or more slots (417, 418) formed in the body of antenna. The adjustable dimensions of the matching structure of the antenna are such as its length, width, and the bending structure. According to a practical need of the antenna, the adjustable structure renders the printed coupled-fed multi-band antenna to serve the suitable operating frequencies and its matching.

Inside the mushroom-shaped radiation portion 411 of the first antenna member 41, especially the portion not next to the second antenna member 42, one or more extended conductors are formed in a manufacturing process as one or more matching sections. The one or more extended conductors, namely the matching sections, are used to tune impedance matching for the printed coupled-fed multi-band antenna. The protrudent structure is used to change the signaling path(s) and signal matching over the antenna. In an exemplary example, the end not close to the second antenna member 42 forms a protruding structure in a manufacturing process such as etching or printing method. The protruding structure is such as a first matching section 415 used to modify the antenna's impedance matching. A second matching section 416 relative to the first matching section 415 is formed in a distance there-between. The space feature may be used to modify the impedance matching. Further, the distance between the first matching section 415 and the second matching section 416 may also affect the matching.

The adjustable factors for the first matching section 415 and the second matching section 416 are such as their area and the distance between the sections 415, 416.

A ground feeding point 431 is formed on a ground plane 43 for the antenna to electrically connect with an electronic system. The ground plane 43 is configurable for fitting the application of the various electronic systems. The electronic system may require a small-sized printed circuit board (PCB) configured to have a specific antenna ground. The antenna may still be applied to the large-sized PCB of an electronic system.

Reference is made to FIG. 5 schematically showing the structural features of the printed coupled-fed multi-band antenna and its related signaling paths.

The printed coupled-fed multi-band antenna mainly has a mushroom-shaped first antenna member 51, a U-shaped second antenna member 52, and a third antenna member 54 which is a rectangular structure extended from a connection portion of the first antenna member 52. The antenna further includes a ground plane 53. This ground plane 53 is not only the portion forming the ground for the antenna, but also adapted to induce a coupling effect with the second antenna member 52. Those structural features form the various signaling paths. The frequency responses over those signaling paths are also tunable through adjusting the structures. Thus, the mushroom-shaped radiation portion itself forms a fourth band signaling path 7 which serves around 1.7 GHz electromagnetic wave.

For achieving the purpose of multiple frequencies, the frequency responses for multiple wavebands can be optimized by means of matching and coupling effects applied to the antenna. In the present embodiment, the third antenna member 54 forms a third band signaling path 6 with relatively shorter distance. Therefore, the third antenna member 54 may serve the electromagnetic wave with higher frequency, e.g. 2.7 GHz.

Accordingly, one of the major features of the printed coupled-fed multi-band antenna is to radiate multiple bands electromagnetic waves over the multiple signal paths made by the small changes of structures.

In an exemplary embodiment such as shown in FIG. 4, the matching section 501 is formed by two matching sections, e.g. the first matching section 415 and the second matching section 416. The areas of the two matching sections and the distance between the two sections are configured to reach a required signal matching.

Over the first antenna member 51, another second matching section 502 extended from the main body is formed. The second matching section 502, as well as the first matching section 501, is at the same side of the first antenna member 51. The second matching section 502 is configured to extend the signal path along the mushroom-shaped radiation portion. The extended length of the second matching section 502 allows the antenna to radiate a specific band electromagnetic wave. The second matching section 502 exemplarily becomes the major radiation portion to form the first band signaling path 5. Still further, the slot(s) formed over the first antenna member 51 in a manufacturing process forms a third matching section 503. The shown slot is a semi-closed slot having an opening and a closed end. The opening of the slot is at one side of the first matching section 501. The first matching section 501, the second matching section 502, and the third matching section 503 commonly form a first band signal path 5 extended from the ground. This path is a longest signal path described as the dotted line over the antenna and mainly serving a low-frequency electromagnetic wave, e.g. 700~900 MHz.

According to the present embodiment, the two radiation arms of the second antenna member 52 respectively form the major structures for signal matching. In addition to the structural features such as its shape, length and width, the coupling effect applied to the adjacent structures is incorporated. For example, one radiation arm with its adjacent ground plane 53 cause a coupling effect so as to form a fourth matching section 504. The other radiation arm and its adjacent first antenna member 51 also cause a coupling effect for forming a fifth matching section 505. After an optimization process, the second antenna member 52 is caused to radiate the second band electromagnetic wave with an optimized frequency response. As shown in the figure, a second band signaling path 8 is therefore formed for serving an around 2.17 GHz electromagnetic wave.

Figure 6:
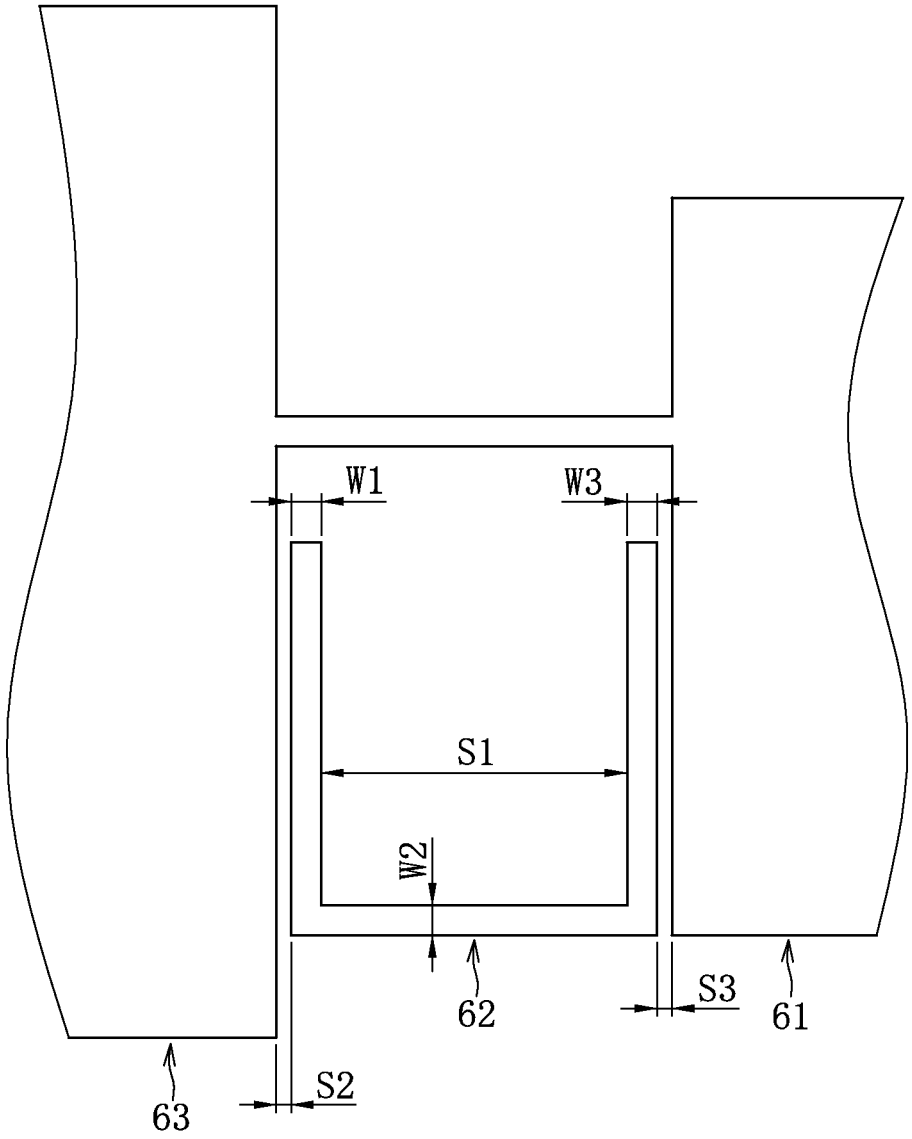
FIG. 6 shows a schematic diagram of the printed coupled-fed multi-band antenna according to one embodiment of the present invention.

Reference is next made to FIG. 6 describing the various tunable parameters for the printed coupled-fed multi-band antenna. For example in the second antenna member 62, the tunable parameters at least include a first spacing S1 between the two radiation arms. The size of the first spacing S1 becomes one of the factors affecting whether or not the second antenna member 62 operates correctly within the waveband. For example, improper distance between the radiation arms may cause an improper LC oscillation, and the wavelength of radiation will be affected.

A second spacing S2 is formed between the second antenna member 62 and the ground plane 63. A third spacing S3 exists between the second antenna member 62 and the first antenna member 61. Both the second spacing S2 and the third spacing S3 affect the coupling effects among the conductors. The proper second spacing S2 and the third spacing S3 allow the printed coupled-fed multi-band antenna in accordance with the present invention to enhance an overall frequency response. However, improper spacings S2 and S3 will damage the frequency response.

The second antenna member 62 is in a form of a U-shaped conductor. Many details of the U-shaped structure affect the radiating wavelength. The shown first width W1, second width W2, and third width W3 respectively cause the frequency responses within the multiple wave bands over the second antenna member 62. The tunable parameters are such as the sizes of the radiation arm and its connected electric connection portion. The radiation arm and the connection portion may have the same or different widths.

Figure 7:
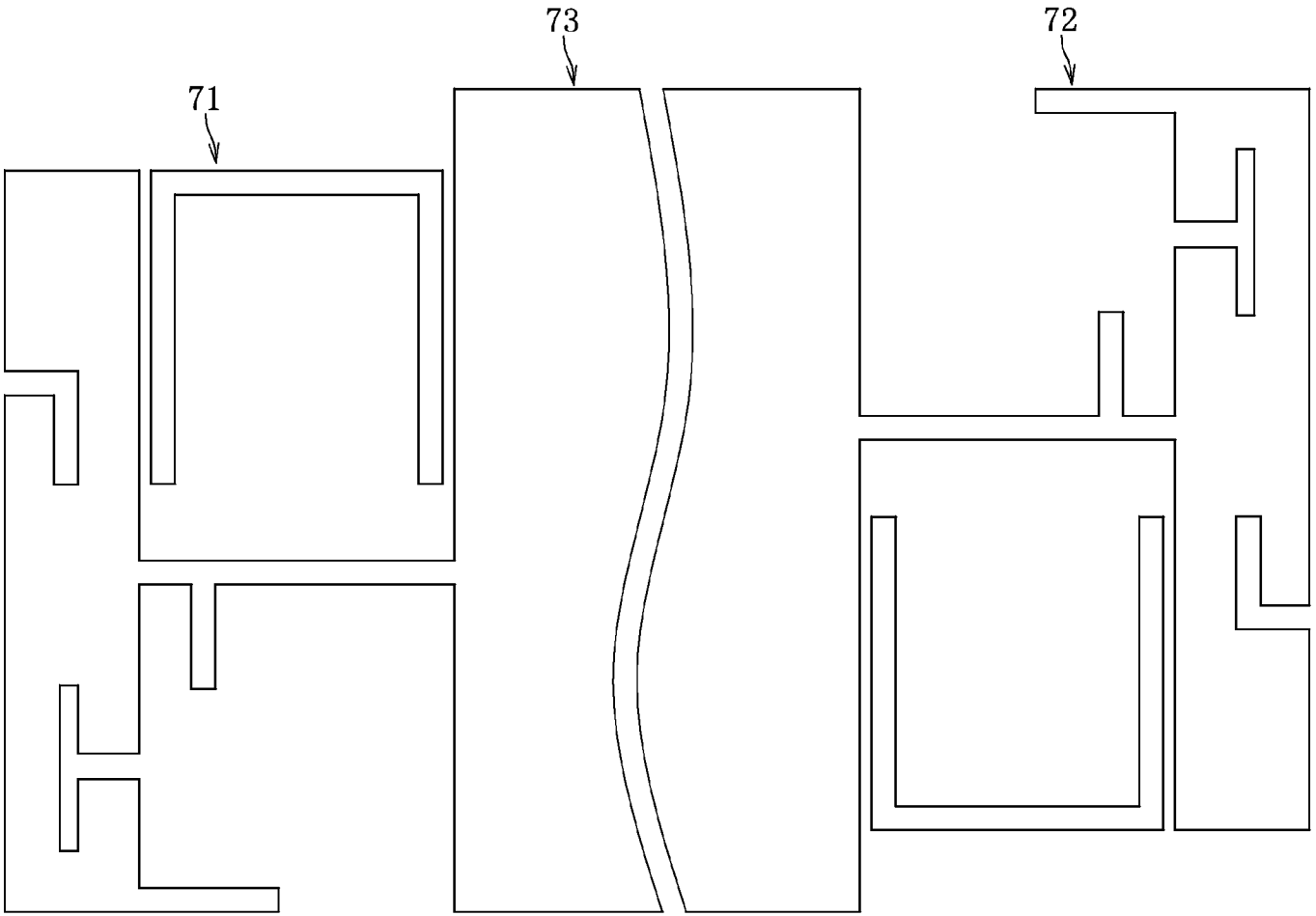
FIG. 7 schematically shows an electronic system with an assembly of the printed coupled-fed multi-band antennas according to one embodiment of the present invention.

The embodiments for the printed coupled-fed multi-band antenna are applicable to an electronic system, as shown in FIG. 7.

The figure shows the main features of the antenna for the electronic system. The features are such as a third component 73 being a printed ground plane, and a first component 71 and a second component 72 are configured to be one or more sets of printed coupled-fed multi-band antenna formed at one or more edges of the ground plane.

Figure 8:
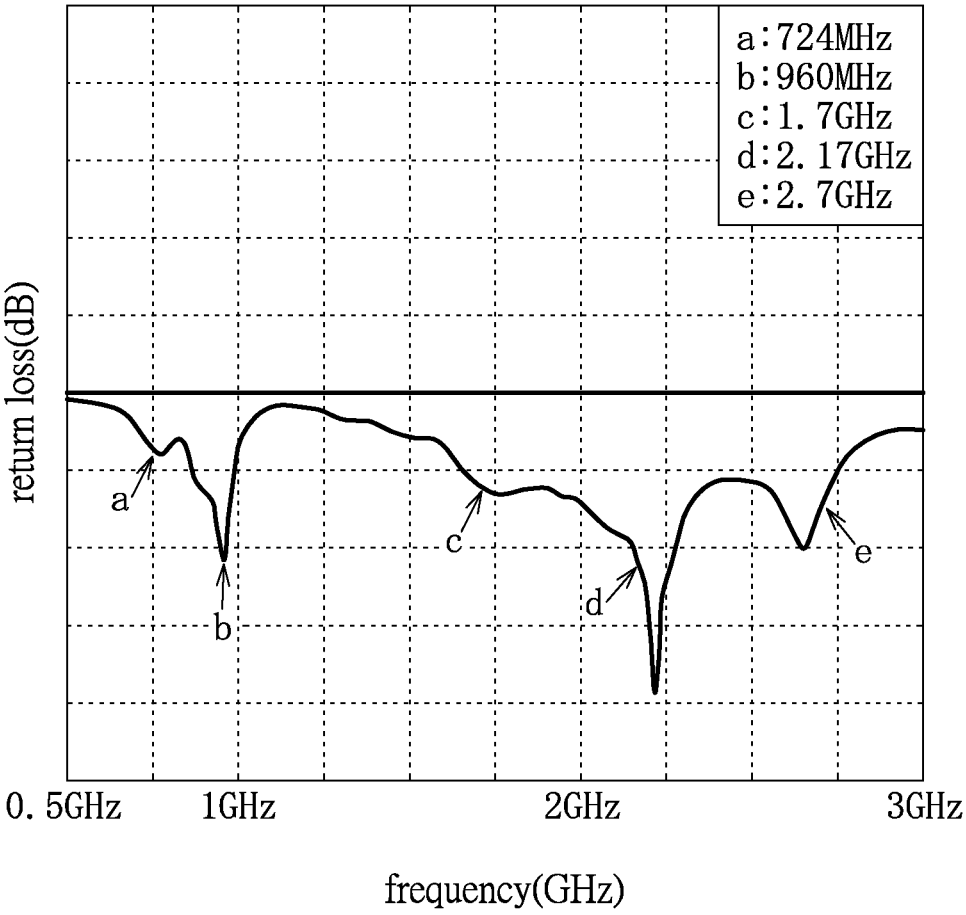
FIG. 8 shows a characteristic chart describing the return loss of the printed coupled-fed multi-band antenna in one embodiment of present invention.

FIG. 8 specifically shows a characteristic diagram of return loss for indicating the operating wavebands and bandwidths over the printed coupled-fed multi-band antenna. The vertical axis denotes the return loss (dB), and the horizontal axis is the frequency (GHz).

The characteristic diagram shows a power ratio of reflected wave and incident wave for an antenna around the bands 0.5 GHz through 3 GHz. The diagram shows that the antenna operates well over multiple wavebands smaller than a return loss (dB). In the diagram, the positions 'a', 'b', 'c', 'd', and 'e' indicate the plurality of operative frequencies. For example, the position 'a' is at the band around the frequency 724 MHz; the position 'b' is at the band around 9602 MHz; the position 'c' is at the band around 1.7 GHz; the position 'd' is at the band around the frequency 2.17 GHz; and the position 'e' is at the band around 2.7 GHz.

The diagram show that the antenna achieves the capability of operating over multiple frequency bands, thus meets the requirement of 3G/4G/LTE operations. The solution disclosed in the specification is to achieve multiple signal paths over the antenna through the structural features. The descriptions in the embodiments show the printed antenna is able to operate at the bands at least around 724 MHz for operating frequency LTE-Band 12 (699~746 MHz), 960 MHz for 3G-Band (860~960 MHz), 1.7 GHz for LTE-Band 3 (1710~1880 MHz), LTE-Band 4 (1710~2155 MHz), 2.17 GHz for operating frequency LTE-Band 1 (1920~2170 MHz), and 2.7 GHz for operating frequency LTE-Band 7 (2500~2690 MHz) since the positions around the bands are with good performance of return loss.

Thus, the disclosure is related to a printed coupled-fed multi-band antenna that is with a standalone adjustment mechanism. Multiple signaling paths can be formed through the configuration of the printed conductor. Further, the designs of slots and various matching structures are useful for the antenna to operate under many frequency bands. The antenna is applicable to an electronic system for rendering flexible operations for various applications of the system.

It is intended that the specification and depicted embodiment be considered exemplary only, with a true scope of the invention being determined by the broad meaning of the following claims.

What is claimed is:

1. A printed coupled-fed multi-band antenna, comprising:

a first antenna member having a mushroom-shaped radiation portion and an antenna connection portion, the mushroom-shaped radiation portion electrically connected with a ground plane via the antenna connection portion; wherein the mushroom-shaped radiation portion is used to activate a first band electromagnetic wave; and a second antenna member being a U-shaped radiation portion and floating within a region surrounded by the mushroom-shaped radiation portion of the first antenna member, the antenna connection portion and the ground plane; wherein the U-shaped radiation portion includes a first radiation arm, a second radiation arm, and an electric connection portion electrically connected with the first radiation arm and the second radiation arm;

wherein, one or more extended conductors are formed in a manufacturing process at one end, not next to the second antenna member, of the mushroom-shaped radiation portion, and the one or more extended conductors are used to tune impedance matching for the printed coupled-fed multi-band antenna; the first radiation arm of the U-shaped radiation portion is adjacent to the ground plane, and generating coupling effect; the second radiation arm is adjacent to the mushroom-shaped radiation portion and generating coupling effect; wherein the coupling effect generated between the first radiation arm and the second radiation arm is to enable the second antenna member to activate a second band electromagnetic wave for inducing an optimized frequency response.

2. The antenna of claim 1, wherein, one or more slots are formed in a manufacturing process within the mushroom-shaped radiation portion, and the one or more slots are used to define one or more radiation portions with one or more specific bands respectively.

3. The antenna of claim 1, wherein the mushroom-shaped radiation portion is a T-shaped radiation portion or an L-shaped radiation portion.

4. The antenna of claim 3, wherein, one or more slots are formed in a manufacturing process within the mushroom-shaped radiation portion, and the one or more slots are used to define one or more radiation portions with one or more specific bands respectively.

5. The antenna of claim 1, wherein, in the U-shaped radiation portion, the first radiation arm, the second radiation arm, and the electric connection portion are printed conductors with the same or different widths.

6. The antenna of claim 5, wherein, one or more slots are formed in a manufacturing process within the mushroom-shaped radiation portion, and the one or more slots are used to define one or more radiation portions with one or more specific bands respectively.

7. The antenna of claim 1, further comprising a third antenna member which is a printed conductor extended from the antenna connection portion of the first antenna member, the extended length is tuned to activate a third band electromagnetic wave.

8. The antenna of claim 7, wherein, one or more slots are formed in a manufacturing process within the mushroom-shaped radiation portion, and the one or more slots are used to define one or more radiation portions with one or more specific bands respectively.

9. The antenna of claim 7, wherein the end of the second antenna member adjacent to the mushroom-shaped radiation portion of the first antenna member has an L-shaped matching section, the length of the L-shaped matching section is tuned to activate a fourth band electromagnetic wave.

10. The antenna of claim 1, wherein the one or more extended conductors form one or more matching sections.

11. The antenna of claim 10, wherein, an area of the every matching section and/or a distance between the adjacent matching sections are tunable.

12. The antenna of claim 11, wherein, one or more slots are formed in a manufacturing process within the mushroom-shaped radiation portion, and the one or more slots are used to define one or more radiation portions with one or more specific bands respectively.

13. The antenna of claim 12, wherein adjusting the one or more slots is to tune operating frequency and matching of the printed coupled-fed multi-band antenna; and a length, a width, and bending structure of the every slot are tunable.

14. An electronic system including the printed coupled-fed multi-band antenna recited in claim 1.

15. The electronic system of claim 14, wherein the electronic system includes one or more printed coupled-fed multi-band antennas disposed over one or more edges of a ground plane.

* * * * *